United States Patent [19]

Robins

[11] 3,999,231

[45] Dec. 28, 1976

[54] COLLAPSIBLE, ADJUSTABLE BED FRAME WITH ADAPTED BOX SPRINGS

[76] Inventor: John A. Robins, P.O. Box 72, Houston, Tex. 77001

[22] Filed: Nov. 12, 1975

[21] Appl. No.: 631,420

[52] U.S. Cl. ..... 5/176 R; 5/185; 5/202

[51] Int. Cl.[2] ..... A47C 19/12

[58] Field of Search ..... 5/131, 149, 156, 76, 5/181, 185, 186, 200 R, 207

[56] References Cited

UNITED STATES PATENTS

| | | | |
|---|---|---|---|
| 683,803 | 1/1901 | Ruebusch | 5/207 |
| 2,550,224 | 4/1951 | Clerc | 5/131 |
| 2,666,931 | 1/1954 | Clerc | 5/181 |
| 3,768,106 | 10/1973 | Fitzgerald et al. | 5/131 |
| 3,881,202 | 5/1975 | Tyhanic | 5/176 R |

*Primary Examiner*—Casmir A. Nunberg

[57] ABSTRACT

A collapsible, adjustable bed frame supporting an adapted box springs.

1 Claim, 3 Drawing Figures

COLLAPSIBLE, ADJUSTABLE BED FRAME WITH ADAPTED BOX SPRINGS

BACKGROUND OF THE INVENTION

This invention relates to bed frames and combined bed frames and box springs.

Generally, bed frames which are used to support box springs consist of support elements arranged peripherally with respect to opposite sides of the box springs which they support. These bed frames are often adjustable by means of changing the length of the end tie elements. However, such bed frames are usually not collapsible, but must be disassembled into two or more sections for storage and shipping.

One disadvantage of the ordinary bed frame comprised merely of peripheral support elements is that it provides no support for the center section of the box springs. This requires the internal construction of the box springs to carry the full load at the center out to its periphery before receiving any support from the frame itself. Realizing this disadvantage, certain prior inventors have sought to provide a means whereby the center sections of the box springs would be more or less directly supported by support elements arranged diagonally beneath the box springs. However, other more sophisticated means for providing a bed frame which itself provides this central support have been developed. See U.S. Pat. Nos. Fitzgerald 3,621,497; Tyhanic 3,881,202; 102 3,744,066; Clerc 2,550,224; Hood & Christmas 250,814; Blin 1,478,937; Sevcik 3,003,158; Bent 870,663. In eliminating this defect, however, these inventors have either completely sacrificed the adjustability of the frame to varying sizes of box springs, see U.S. Pat. Nos. Fitzgerald 3,621,497; Blin 1,478,937; or have to some degress sacrificed the simplicity of the adjustment means or have impaired the adjustability of the bed frame to varying sizes of box springs. See U.S. Pat. Nos. Tyhanic 3,881,202; Sevcik 3,003,158; Bent 870,663; Longnecker 274,749. Conversely, those inventors who have been conscious of the need to retain the simplicity and degree of the adjustment of the bed frame have been forced to sacrifice the effectiveness of the support provided by the internal support elements of their inventions. See U.S. Pat. Nos. Clerc 2,666,934; Falivene 3,744,066. Some of these inventors in their attempts to fulfill both the objects of internal support and of adjustability have failed to some degree to fulfill either of them. See U.S. Pat. Nos. Clerc 2,550,224; Longnecker 2,674,749.

Two particular problems which have been encountered in the design of adjustable bed frames have been the difficulty of limiting the number of adjustment points, see U.S. Pat. Nos. Tyhanic 3,881,202; Falivene 3,744,066; Bent 870,663; Longnecker 2,674,749; Clerc 2,550,224; Clerc 2,666,931; and the difficulty of limiting the number of points at which the bed frame is locked into the position to which it has been adjusted. See U.S. Pat. Nos. Tyhanic 3,881,202; Bent 870,663; Longnecker 2,674,749; Clerc 2,550,224. In certain designs these two problems are integrated since the means of adjustment also serves some locking function. U.S. Pat. Nos. Sevcik 3,003,158; Longnecker 2,674,749. Other designs have neglected to provide any locking means at all. Clerc 2,666,931; Falivene 3,744,066.

Finally, many of the conventionally designed bed frames require the use of a material with an L shaped cross section in the construction of the support elements. This L-shaped cross section is required to hold the box springs securely in place, as well as to facilitate the placement of the transverse wooden slats which provide a means for supporting the internal sections of the box springs. U.S. Pat. Nos. Rosenfeld 2,567,619; Blanke 2,664,959; Sands 2,745,117; Roche 2,772,424; Harris 3,555,579; Spitz 3,781,930.

Accordingly, it is an object to provide a bed frame which may be simply adjusted to accomodate box springs of varying sizes by means of support elements radially arranged about and pivotally carried by a common connecting element.

A further object is to provide a means whereby adjustments may be secured by a simple locking means located at the common connection element.

A further object of this invention to provide a bed frame wherein at least some internal transverse structural members of the box springs are supportively carried by the bed frame by means of support elements directly beneath these members.

It is a further object to provide a bed frame which does not require the use of materials of L-shaped cross section.

Further objects will become apparent upon reading the following specification and claims and referring to the accompanying drawings.

DESCRIPTION OF THE PREFERRED EMBODIMENT

The instant invention defines a multiplicity of radially arranged support elements all of which are carried by a common connecting means, one or more of which radial support elements are pivotally carried by common connecting means and a means for supporting the bed frame above the floor level. It is preferred that filler elements be attached to the lower surfaces of at least some of the internal transverse ties of the box springs in such a manner that the filler elements engage and are supportively carried by the bed frame.

Figure 1:
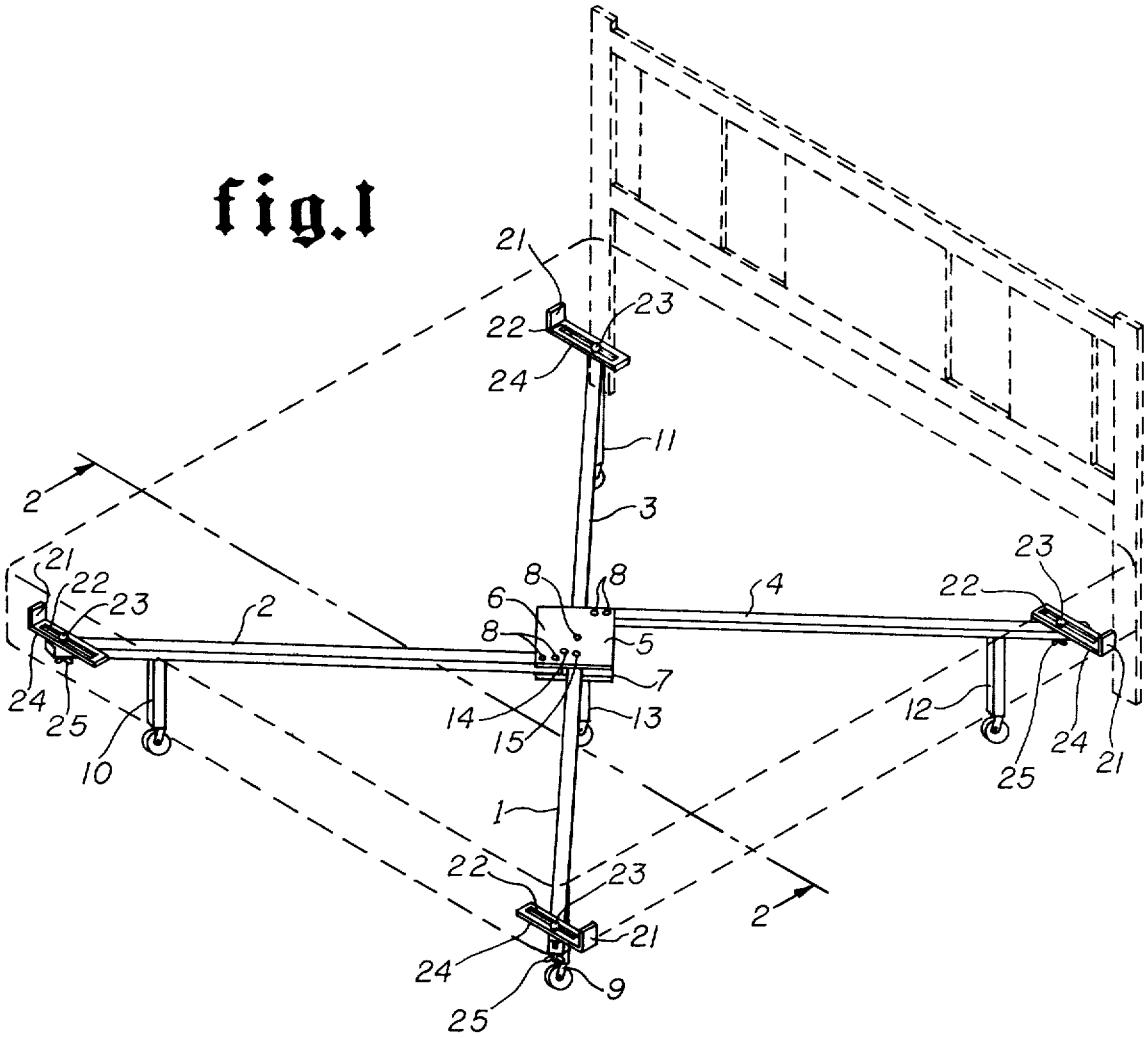
FIG. 1 is a perspective view illustrating the preferred embodiment of the bed frame and box springs with the head board and box springs shown in phantom lines.

In the preferred form the radially arranged support elements are supportively carried by a common connecting means centrally located with respect to the circle defined by the radius of the radial support elements. Referring now to FIG. 1, four radial support elements 1,2,3 and 4 are shown.

Figure 3:
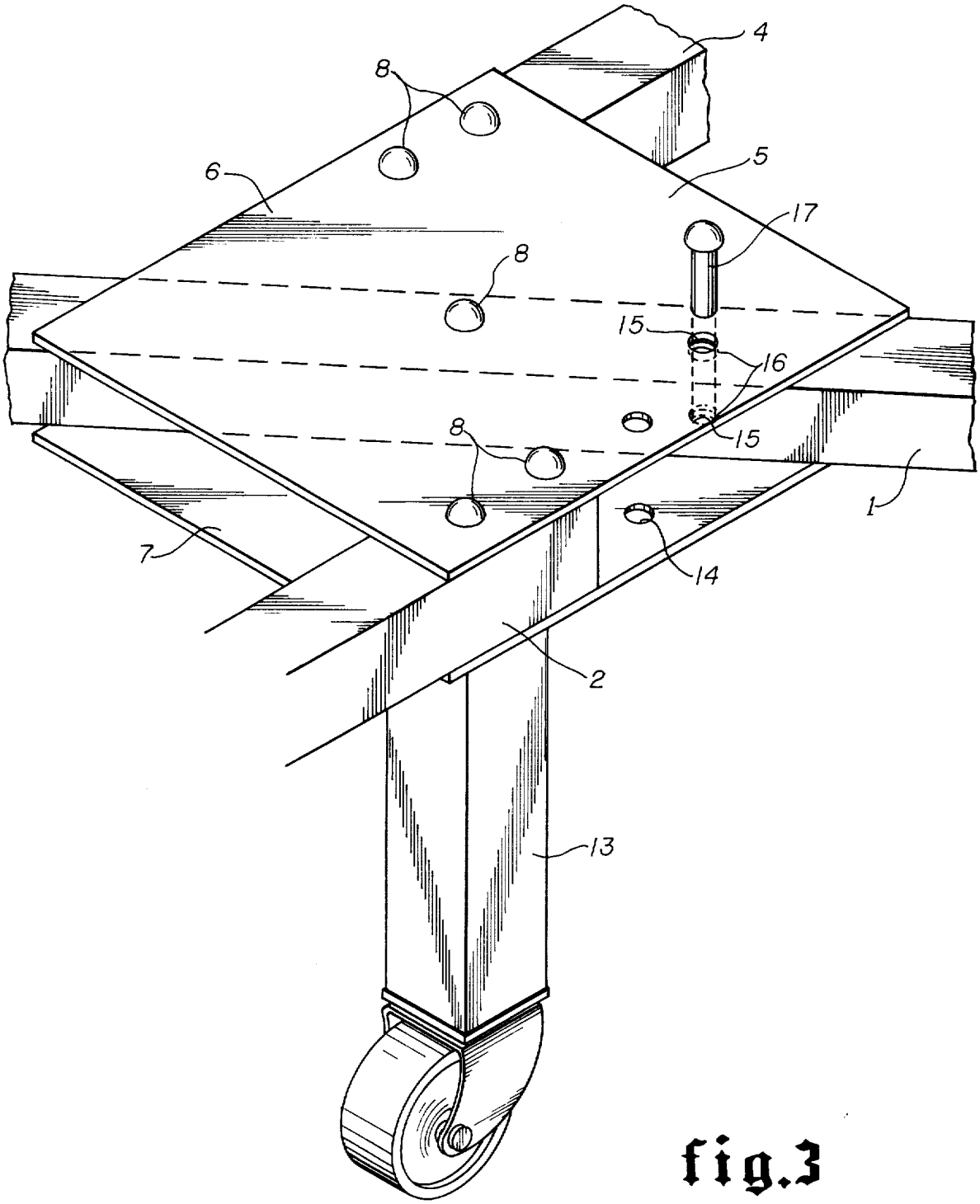
FIG. 3 is a perspective view illustrating the preferred embodiment of the common connecting and support means located centrally with respect to the circle defined by the radius of the radial support elements.

The preferred embodiment of the common connecting means, a hinge plate 5, is also shown in FIGS. 1 and 3. The hinge plate 5, is comprised of two plates, an upper plate 6, and a lower plate 7 of identical construction which are displaced vertically one above the other an appropriate distance for the radial support elements 1–4 to be pivotally inserted therebetween. In both the upper plate 6 and the lower plate 7 holes are provided which will be aligned with the appropriate mounting holes in the radial support elements and through which bolts 8 will be passed to connect said radial elements 1–4 either in a stationary position or pivotally to the hinge plate 5. The preferred embodiment of two of the radial support elements is a single length of support material such as a box section of metal which is pivotally carried by the hinge plate 5, at the support elements longitudinal mid point in order to form the two radial support elements 1 and 3. In the preferred embodiment, the other two radial support elements 2 and 4 are supportively carried by the hinge plate 5 in a stationary position by two bolts 8.

The bed frame structure is itself supportively carried by a support means which supports the structure at a level above the floor. Referring to FIG. 1, the preferred means for supporting the bed frame structure above the level of the floor is a multiplicity of support legs 9, 10, 11, 12, and 13.

The angular disposition of the radial support elements at the common connecting means may be adjusted by pivoting the pivotally carried radial support elements. Such adjustments may be secured by a locking means at the common connecting means. The preferred embodiment of such locking means is illustrated in FIGS. 1 and 3. Referring to FIGS. 1 and 3, the preferred embodiment of the common connecting means, the hinge plate 5, pivotally carries the radial support elements 1 and 3. As previously disclosed the radial support elements 1 and 3 of the preferred embodiment consist of a single length of support material. Thus, radial support elements 1 and 3 may be secured in position by a common locking means the preferred embodiment of which comprises a multiplicity of pairs of vertically aligned holes 14 and 15 in the upper and lower surfaces of the hinge plate 5 which may be aligned with a similar pair of vertically aligned holes 16 in the radial support element 1. A pin 17 may be passed through the selected pair of holes in the hinge plate 5 after they have been aligned with the pair of holes 16 in the radial support element 1.

Figure 2:
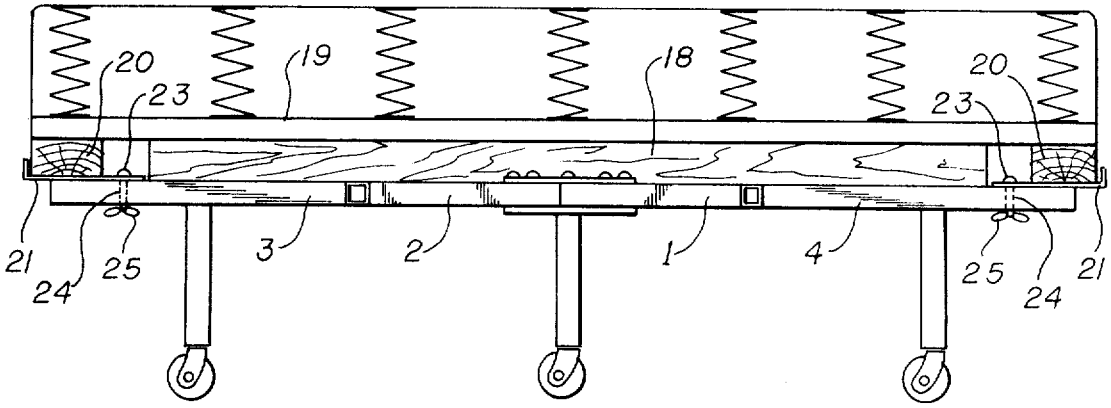
FIG. 2 is a partial section view of the preferred embodiment of the bed frame and box springs taken along the line 2—2 in FIG. 1 illustrating the means for supporting the transverse elements of the box springs by the radial support elements.

A means for supporting the transverse ties of the box springs by the radial support elements and the common connecting means are provided by a filler located between the lower surfaces of the transverse ties and the upper surfaces of said support elements of the bed frame structure. The preferred embodiment of this combination is illustrated by FIG. 2. Referring now to FIG. 2, the preferred embodiment of the filler element is shown to be a wooden slat 18 attached to the lower surface of the conventional transverse ties 19 of a box spring in such a manner that the lower surface of the wooden slat 18 is coplanar with the lower surfaces of the peripheral support members 20 of the box springs. Thus, the lower surfaces of the transverse slats of a conventional box springs may be uniformly carried by the support elements of the bed frame structure.

An adjustable means for preventing the movement in opposite directions of the box springs upon the bed frame structure is disclosed. The preferred embodiment of such means is illustrated by FIGS. 1 and 2. Referring now to FIGS. 1 and 2, the preferred embodiment of the adjustable means for preventing the movement in opposite directions of the box springs upon the bed frame structure is shown to be multiplicity of L-shaped elements 21 adjustably carried by the outer ends of the radial support elements 1, 2, 3 and 4. These elements may be adjusted by movement of the L-shaped elements 21 in a plane parallel to that of the lower surfaces of the box springs and the upper surfaces of the radial support elements 1, 2, 3 and 4 of the bed frame structure until the upper and inner surfaces of the L-shaped element engage the lower and outer surfaces, respectively, of the peripheral support elements 20 of the box springs. In the preferred embodiment of the means of adjustment the L-shaped element is provided by longitudinal slots 22 in the portion of the L shaped elements 21 which engage the upper surface of the radial support elements 1, 2, 3 and 4. A threaded bolt 23 is passed through this slot and a pair of holes 24 in the outer ends of the radial support elements and is secured by a winged nut 25. The adjustment is secured by tightening winged nut 24 in such a manner that the L-shaped element is held in the position to which it has been adjusted.

The preferred method of operation of the bed frame is as follows: first, taking the bed frame in its collapsed position for shipment where radial support elements 2 and 4 are parallel with radial support elements 1–3; the pivotally carried support elements 1–3 should be rotated clockwise until the pair of vertically aligned hole 16 in radial support element 1 are aligned with the desired locking holes 14 or 15 in the hinge plate 5. Once these pairs of holes are in aligned position the locking pin 17 may be passed through the selected pair of holes in order to lock the bed frame in the desire position, thereby fixing it width. For instance the holes 14–15 may be positioned to lock the frame in position to support either a single or double width box spring. The wing nuts 25 should be loosened so that the L-shaped elements are freely movable to the farthest extent of their longitudinal travel in the slots 22. The box springs is then layed upon the bed frame and the L-shaped elements 21 are adjusted so that the lower portion of the L engages the peripheral edges of the box springs. The wing nuts 25 should then be tighten so that the L-shaped elements 21 will not slide in their longitudinal slots 22. In order to disassemble the bed the reverse procedure should be followed.

It is evident from the foregoing description that this bed frame structure and box springs provides an easily adjustable, collapsible bed frame which provides a means of support for the internal structural elements of the box springs. Furthermore, it is evident that such means of support is provided without the necessity for using peripheral support elements of L-shaped cross section.

Although the preferred embodiment of the invention has been described above, that embodiment is illustrative only; the invention is limited solely by the appended claims.

What is claimed is:

1. A box-springs and frame comprising:

a frame including a common connecting means, a multiplicity of support elements extending radially from said common connecting means and having co-planar upper surfaces, at least two of said support elements being pivotally carried by said common connecting means, with the peripheral ends of each of said support elements being free from the other support elements, whereby the width of the frame may be adjusted by changing the angle of disposition of the support elements, means for latching the said support elements in a desired angular position at the common connecting means, adjustable means at the free end of each support element for preventing the movement in opposite directions of a box springs supported on the frame, and support legs carried by the common connecting means and by the support elements;

and a box springs including longitudinal runners on each side, transverse slats connected to the upper surfaces of said longitudinal runners, and at least one filler element connected to at least one transverse element and having a lower surface in the plane of the lower surface of the said longitudinal runners and engaging the bed frame.

* * * * *